US005782359A

United States Patent [19]

McAllister et al.

[11] Patent Number: 5,782,359

[45] Date of Patent: Jul. 21, 1998

[54] CHILD PROOF PILL CONTAINER

[76] Inventors: Angel F. McAllister; Steven R. McAllister, both of 231 N. East St., Manly, Iowa 50456

[21] Appl. No.: 833,358

[22] Filed: Apr. 4, 1997

[51] Int. Cl.[6] ..... B65D 83/04

[52] U.S. Cl. ..... 206/538; 206/1.5; 220/507; 220/524

[58] Field of Search ..... 206/536, 538, 206/540, 1.5; 220/500, 507, 523, 524, 526, 339, 23.8, 293, 298, 300; 215/332

[56] References Cited

U.S. PATENT DOCUMENTS

| | | | |
|---|---|---|---|
| D. 271,081 | 10/1983 | Noble . | |
| 2,613,518 | 10/1952 | Karoff | 220/507 |
| 2,749,198 | 6/1956 | Berber | 220/507 |
| 3,085,679 | 4/1963 | Burrell . | |
| 3,450,306 | 6/1969 | Gill . | |
| 3,870,192 | 3/1975 | Haley . | |
| 4,083,452 | 4/1978 | Rossmo . | |
| 4,124,143 | 11/1978 | Thomas . | |
| 4,261,468 | 4/1981 | Krebs . | |
| 5,154,296 | 10/1992 | Cutler . | |
| 5,226,539 | 7/1993 | Cheng . | |

*Primary Examiner*—M. D. Patterson
*Assistant Examiner*—Nhan T. Lam
*Attorney, Agent, or Firm*—Zarley, McKee, Thomte, Voorhees, & Sease

[57] ABSTRACT

An apparatus for storing medication and the like which includes a container with a plurality of compartments and a lid such that when lid is in a closed position compartments cannot be opened. The container includes a base, inner wall, outer wall, divider parts which extend from the inner wall to the outer wall forming the plurality of compartments, enclosures which cover each compartment, and a threading cylinder which extends upward from the inner wall. The lid is in the form of a cylinder with extensions that extend from the lower inner portion of the lid such that when aligned with the threading cylinder and downward pressure and clockwise movement is applied the enclosures that cover compartments cannot be opened.

20 Claims, 2 Drawing Sheets

CHILD PROOF PILL CONTAINER

BACKGROUND OF THE INVENTION

A. Field of the Invention

The present invention relates to a container for storing medication and the like in a safe and inexpensive manner.

B. Problems in the Art

Containers for storing pills and tablets are well known and come in a variety of forms and prices. Some pill boxes are decorated to provide a pleasing effect. Other pill containers serve the functional purpose of monitoring dosage by separating pills into individual compartments. While the functional pill containers come in a variety of shapes and sizes, generally they consist of a base with a plurality of compartments for holding pills. To access a pill, generally an opening in the cover must be rotated and aligned with the pill compartment to allow the pill to exit the opening.

The value of a functional container is that it allows an individual to monitor daily medication dosages to prevent an underdose or overdose because of memory lapses. For example, if an individual is to take two pills per day, one in the morning and one in the afternoon, the individual may neglect a pill thinking the pill was already taken. Likewise, in the late afternoon, the individual may take a third pill, forgetting that the afternoon pill had already been taken.

To overcome potential memory lapses in taking medication there are presently available containers designed to dispense pills over an entire week, as well as other containers designed to dispense pills at specified times throughout the day. However, many of the foregoing do not solve the problem of protecting young children from gaining access to the contents of the container.

Child proof locking devices are also well-known. Examples of different types of pill dispensers with locking devices can be found in the following issued United States patents:

| U.S. Pat. No. | Inventor | Issued Date |
|---|---|---|
| 3,870,192 | Haley | 03/11/75 |
| 4,083,452 | Rossmo | 04/11/78 |
| 4,124,143 | Thomas | 11/07/78 |

The Rossmo patent requires the user to carry out a predetermined sequence of steps before the container can be unlocked. The predetermined sequence causes a ball to move from one position where a catch is released to a second position wherein movement of a catch is prevented.

The Thomas and Haley locking arrangements have a releasable actuator which frees the cover for rotation relative to the base. The cover has a pill exit opening formed to selectively permit the exit of a single pill from one compartment.

Consequently, an individual must either remember and execute a complicated predetermined sequence to access medication, or is limited to dispensing a single pill at a time as a result of the locking system design which because of its movable parts is subject to ware and a limited life span.

The child proof pill container was develop to overcome the above limitations. The container has a plurality of compartments large enough to hold a multiple supply of pills. Each compartment has a cover which fits under a lid and can be closed by pressing on the lid in a downward clockwise motion. To open a compartment an individual applies pressure to the lid in a downward counter clockwise motion and can thereby monitor daily medication dosages and protect young children from gaining access to the contents.

Therefore, a principal object of the present invention is to provide a child proof pill container which overcomes or solves the problems and deficiencies in the art.

Another object of the present invention is to provide a container having a means enabling the user to monitor medication dosage over a time period.

Another object of the present invention is to provide compartments enabling a user to store a multiple number of pills.

Another object of the present invention is to enable the user to easily determine what items have been dispensed from each compartment.

Another object of the present invention is to provide a container normally closed to prevent access by young children and including a simple method for opening the container.

Another object of the present invention is to provide an economically manufactured container for the storage of medication.

Another object of this invention is to provide a marking system for blind individuals to monitor medication dosage over a period of time.

Another object of the present invention is to provide a simple self-locking container that is easy to engage and comprises of a minimum number of parts.

These and other objects, features, and advantages of the present invention will become more apparent with reference to the accompanying specification and claims.

SUMMARY OF THE INVENTION

The invention allows an individual to monitor a daily dosage of medication, while at the same time closing the container to prevent young children from gaining access. The container has a base, inner wall, outer wall, and divider parts which separate the container into a plurality of compartments. Each compartment has an enclosure which is attached to the outer wall in a movable manner such that it may cover and interlock with the compartment in a closed position. Attached to the inner wall is a threading cylinder which has groves with a lip near the top of the cylinder between the groves. The enclosures have tips which extend pass the inner wall and fit into the groves of the threading cylinder. A detachable circular lid fits over the threading cylinder with knobs on the inside lower edge of the lid that fit the groves of threading cylinder. When the lid is aligned with the grooves of the threading cylinder and downward pressure and clockwise movement are applied, the knobs on the lower edge of the lid will fit under the lip of the cylinder between the groves holding the enclosures in place. When downward and counter clockwise movement are applied to the lid the knobs release allowing one to detach the lid from the container. The invention therefore allows one to monitor a daily dosage of medication while at the same time preventing access by young children to the contents of the container.

DESCRIPTION OF THE PREFERRED EMBODIMENT

Figure 1:
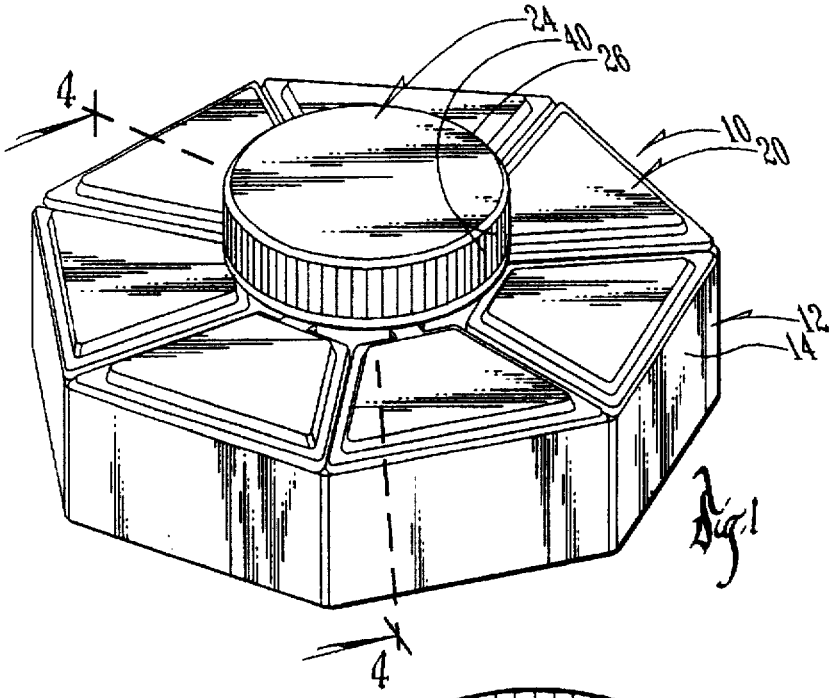
FIG. 1 is a perspective view of the pill container of this invention with the lid in a closed position.

In order to assist in an understanding of the invention, a description of the preferred embodiment of the invention will now be made in detail. It is to be understood that this description is not intended, nor does it necessarily limit the invention.

The attached drawings will be referred to in this description. Reference numerals will be used to indicate selected parts and locations in the drawings. The same reference numerals will be used in all the drawings for the same parts or locations, unless otherwise indicated.

Referring to FIGS. 1, 2, 3, and 4, a pill container 10 comprises a base 12, an outer wall 14, an inner wall 16, divider walls 18, and enclosures 20 in the form of a cover, the divider walls 18 having a plurality of radiating walls extending from a central column known as the inner wall 16 to the outer wall 14 of the container 10. The divider walls 18, the inner wall 16, the outer wall 14, the base 12, and the enclosures 20 can be integrally molded with the container 10. The inner wall 16 is in the form of a circular shape with flat surfaces that connect and change directions when the inner wall 16 meets the divider parts 18. The outer wall 14 is likewise in the form of a circular shape with flat surfaces that connect and change direction when the outer wall 14 meets the divider walls 18. The outer wall's 14 circumference is greater than the circumference of inner wall 16. The divider walls 18 separate the interior of the container 10 into a plurality of compartments 19. The enclosures 20 are integrally molded with the outer wall 14 by a wing hinge 38 such that the enclosure can be opened and closed over the compartments 19.

As part of the inner wall 16, a threading cylinder 22 in the form of a circle having upwardly extending fingers 29. A lid 24, in the form of a circle, fits the threading cylinder 22 requiring downward pressure and clockwise rotation to activate a closed position 26 as shown in FIG. 1. The lid 24 is of a child proof nature requiring downward pressure and counter clockwise rotation to activate threaded release. The lid 24 has extensions 28 in the form of small rectangular blocks which are equally spaced on the bottom of the inner portion of said lid 24 which fit with groves 30 in the threading cylinder 22. The threading cylinder 22 has a lip 32 in the form of a thin rectangular ledge which extends outward on the exterior of the upward extending fingers 29. When the lid extensions 28 fit in the cylinder groves 30 and downward pressure is applied with clockwise rotation, the lid extensions 28 will fit under the cylinder lip 32 establishing a closed position 26 as shown in FIG. 1. The lid 24 has vertical ridges 40 on the exterior portion which provide greater friction when applying pressure and movement.

The enclosures 20 are in the form of a trapezoid. The enclosures 20 have a small tip 34 that extends beyond the inner wall 16 of the container 10 and fit in the groves 30 of the threading cylinder 22 such that when the enclosure 20 covers the compartment 19 and the lid 24 is in the closed position 26 as shown in FIG. 1, enclosure 20 cannot be moved to open the compartment 19. The enclosure has a curb 42 in the form of a trapezoid on the bottom portion of the enclosure 20 that extends downward and interlocks with the outer wall 14, inner wall 16, and the divider walls 18 of the compartment, whereby engagement between the enclosure 20 and the compartment 19 is obtained. The enclosures 20 have a nib 36 connected to outer edge of the curb 42, underneath the tip 34, and extending outward to interlock with the inner wall 16.

Figure 2:
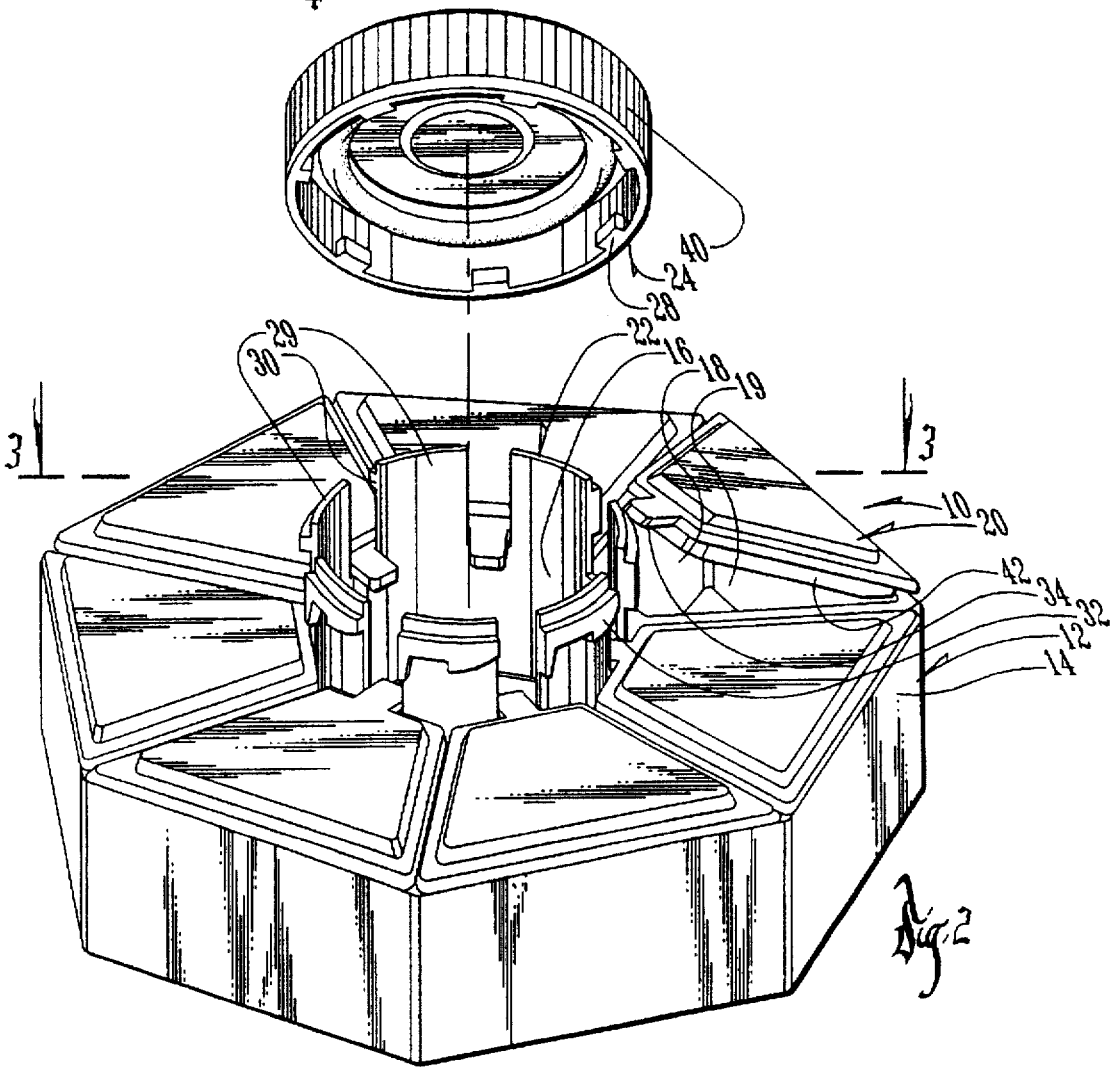
FIG. 2 is a perspective view of the pill container with the lid in an open position and an enclosure in an open position.
Figure 3:
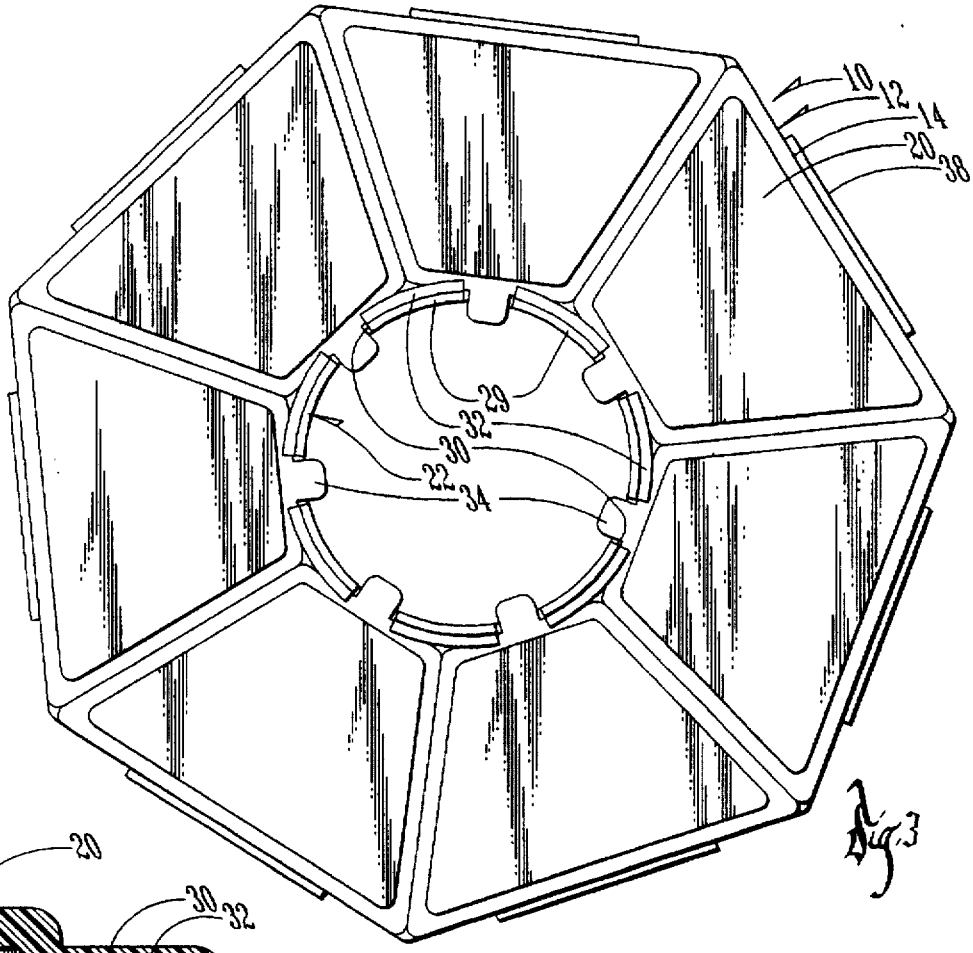
FIG. 3 is a top plan view of FIG. 1 with the tip extensions of the enclosures shown.
Figure 5:
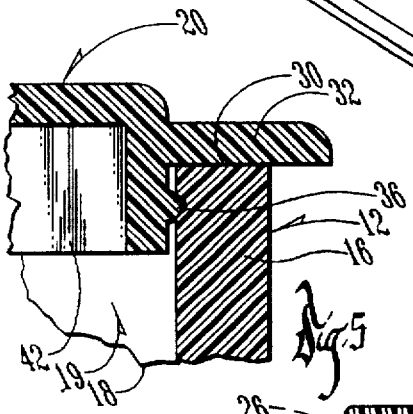
FIG. 5 is a end view taken of line 5—5 of FIG. 4.
Figure 4:
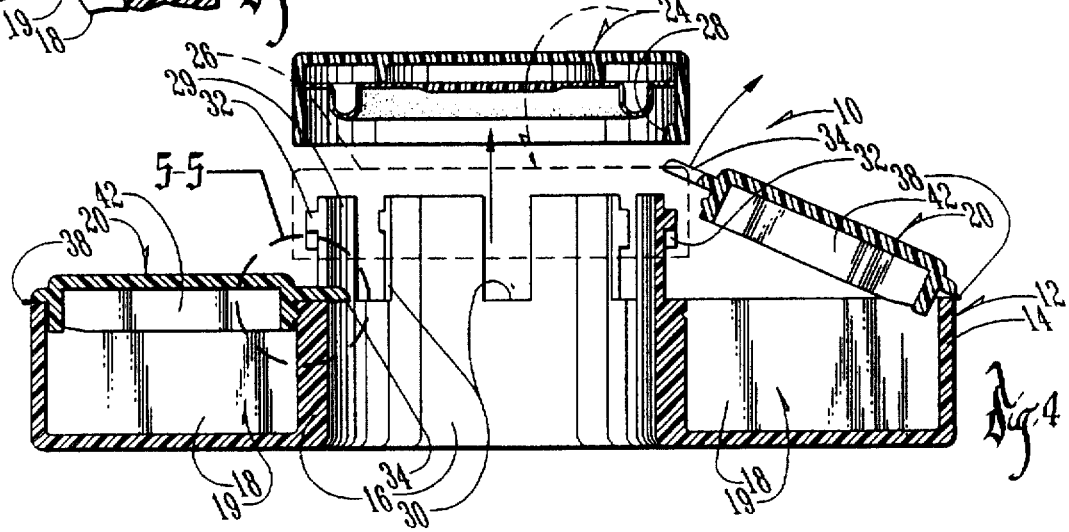
FIG. 4 is an end view of FIG. 3 with the lid in the closed position shown by dotted lines and the extension shown both in a closed and opened position.

The use and operation of the invention are as follows: the container of the invention is of maximum simplicity, being formed of two elements or parts as shown in FIG. 2. The container is filled by placing the objects to be dispensed in the separate compartments 19. The enclosures 20 are then moved to cover the compartments 19. The lid extensions 28 are then aligned with the groves 30 of the threading cylinder 22. By applying downward pressure and clockwise movement the lid 24 is moved to the closed position. The enclosures 20 may be entirely or partially transparent to disclose the number of objects contained in each compartment 19. A variety of known plastic materials may be employed in forming the container 10, all of which materials are known to be usable without deleterious effect upon the medical or similar objects contained in each compartment 19.

To open the container 10, downward pressure is applied to the lid 24 and counter clockwise rotation is applied allowing one to remove the lid 24 and open the enclosures 20 for each compartment 19. Thus, a young child attempting to open the container 10, when it is in a closed position 26, would be unable to do so without knowledge of the function and means of opening the container 10.

Various modifications of the above-described preferred embodiment will be apparent to those skilled in the art and may be made without departing from the spirit or scope of the attached claims.

We claim:

1. An apparatus for storing medication which comprises:

a container having a base, an outer wall, an inner wall, and divider parts which extend out from the inner wall to the outer wall separating space into a plurality of compartments, enclosures which fit over the top of each compartment, a threading cylinder which extends upward from the inner wall of the container, and a lid which is detachable from the threading cylinder.

2. The container according to claim 1 wherein lid structure fits the threading cylinder such that downward pressure and clockwise movement are required to activate the closed position.

3. The container according to claim 1 wherein lid structure requires pressure and counter clockwise movement to activate threading release whereby the lid is child resistant.

4. The container according to claim 1 wherein said lid has extensions equally spaced on a bottom of the inner portion of said lid which fit with grooves in the threading cylinder, the threading cylinder having a lip on the exterior cylinder in between the grooves such that when lid extensions fit in the cylinder grooves and downward pressure is applied with clockwise movement, lid extensions fit under the cylinder lip resulting in closed position.

5. The container according to claim 1 wherein said enclosures have a small tip that extends beyond the inner wall of said container and fits in grooves of the threading cylinder such that when an enclosure covers said compartment and the lid is in a closed position the enclosure cannot be moved to open the compartment.

6. The container according to claim 1 wherein said enclosures have a curb and a nib set inside an outer edge of the enclosure and extending downward to interlock with the outer and inner walls, plus the divider parts of the compartment, whereby engagement between the enclosure and the compartment is obtained.

7. The container according to claim 1 wherein said enclosures are separated on the inner wall and divider part and attached to the outer wall by a flexible portion allowing movement to close and open said compartment.

8. The container according to claim 1 wherein said container is shaped in a seven-sided configuration.

9. The container according to claim 1 wherein said container is made of a material that has no deleterious effect upon the contents in each compartment.

10. The container according to claim 1 wherein said enclosures have a nib connected to an outer edge of a curb, curb, underneath the tip, and extending outward to interlock with the inner wall.

11. The container according to claim 1 wherein said enclosures are made of a transparent material.

12. The container according to claim 1 wherein said enclosures have indentations on the bottom portion of the said enclosures which correspond with specific time intervals.

13. The container according to claim 1 wherein said enclosures have indentations in Braille on the bottom portion of the said enclosures which corresponds with specific time intervals.

14. The container according to claim 1 wherein said container has an inner wall formed in a circular shape with flat surfaces that connect and change directions where the inner wall meets the divider parts.

15. The container according to claim 1 wherein said outer wall formed in a circular shape with flat surfaces that connect and change directions where the outer wall meets the divider parts.

16. The container according to claim 1 wherein the circumference of the said outer wall is greater than the circumference of said inner wall of said container.

17. The container in claim 1 wherein said enclosures are made in the form of a trapezoid.

18. The container according to claim 1 wherein lid and threading cylinder are made in the form of a circle.

19. The container in claim 1 wherein said divider parts, said base, said inner wall, said outer wall, and said enclosures are integrally molded into one piece whereby a movable part allows enclosures to open and close over compartments.

20. The container in claim 1 wherein said lid has vertical ridges on exterior.

* * * * *